US007334359B1

(12) United States Patent
Palmer

(10) Patent No.: US 7,334,359 B1
(45) Date of Patent: Feb. 26, 2008

(54) DEVICE FOR RECORDING OR ASSIGNING THE USE OF ARTICLES OF APPAREL

(76) Inventor: Pamela Reitz Palmer, 212 Cheekwood Ct., Franklin, TN (US) 37069

( * ) Notice: Subject to any disclaimer, the term of this patent is extended or adjusted under 35 U.S.C. 154(b) by 0 days.

(21) Appl. No.: 11/039,734

(22) Filed: Jan. 20, 2005

Related U.S. Application Data

(60) Provisional application No. 60/539,279, filed on Jan. 27, 2004.

(51) Int. Cl.
*G09F 3/00* (2006.01)

(52) U.S. Cl. ..... 40/322; 223/98

(58) Field of Classification Search ..... 40/322; 223/98

See application file for complete search history.

(56) References Cited

U.S. PATENT DOCUMENTS 1,785,948 A 12/1930 Garrety
1,786,923 A * 12/1930 Scruby ..... 223/88
2,054,654 A * 9/1936 Friedman ..... 223/98
2,434,461 A * 1/1948 Forcheimer ..... 223/98
2,533,864 A * 12/1950 Wordingham ..... 223/98
2,774,527 A * 12/1956 Iverson ..... 223/98
3,124,284 A * 3/1964 Collum ..... 223/98
3,153,499 A * 10/1964 Babiskin et al. ..... 223/88
5,423,139 A 6/1995 Feldman
6,035,570 A 3/2000 Maglio

* cited by examiner

*Primary Examiner*—Gary C. Hoge
(74) *Attorney, Agent, or Firm*—David D. Winters

(57) ABSTRACT

A machine for recording or assigning the use of articles of apparel having a sheet of stiff material, perforated and folded over the hook of a hanger, and having one or more substantially flat surfaces upon which notes, assignments, usage advertisements, or other data maybe recorded.

2 Claims, 4 Drawing Sheets

DEVICE FOR RECORDING OR ASSIGNING THE USE OF ARTICLES OF APPAREL

CROSS REFERENCE TO RELATED APPLICATIONS

This application is based on provisional application Ser. No. 60/539,279, filed on Jan. 27, 2004.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of clothing data devices and more specifically to a machine for recording or assigning the use of articles of apparel.

A significant component of business and social events, and particularly of events in the public eye, is that of the participants' apparel. Repeated use of the same articles of clothing in multiple appearances, or single badly matched combinations thereof, can damage the wearer's social or professional image. The probability of such eventualities may be somewhat mitigated by possession of extensive wardrobes. However, such wardrobes may be prohibitively expensive. Further, undesirable chance repetitions may occur no matter how voluminous the contents of one's clothes closet.

Short of discarding each piece of apparel immediately after the first time it is worn, the only way to prevent undesirable repetitions before the same clientele or observers is to keep a record of usage for each piece of clothing. Further, to save time and to prevent badly conceived last minute combinations of color, style, cloth or other characteristics, advance planning is a desirable preventive measure.

The herein taught technology provides a convenient medium for recording or planning apparel combinations, and due to its utility and potential for continued use, it also has promise as a long-term advertising medium. This is because its utility provides an incentive for the user to retain the device, thereby preserving the associated advertising copy.

Previously Taught Technology

U.S. Pat. No. 1,785,948 teaches an integrated hanger and display device specifically for use in advertising. This device comprises one surface for display of advertising information. Being presented for the sole purpose of advertising, it is configured in a manner more suited for artistic or graphic displays than for record keeping. As designed and claimed, the device backside remains unavailable for record data, thus further limiting its usefulness for record keeping. With no useful function except advertising, the user/customer has little incentive to retain or preserve the device and its associated advertising information.

U.S. Pat. No. 5,423,139 teaches a combination care and inventory label employing a detachable tag with fixed data in text and machine readable code. It is not intended for nor easily adapted to manual record keeping or data entry.

U.S. Pat. No. 6,035,570 teaches a tracking device for attaching to clothing and/or clothing accessories, comprising a rectangular piece of sheet material holed and scored for mounting it with or on clothing. As claimed, its shape and design provide minimal space for recording repeated or columnar data, and it does not have significant space for advertising copy.

BRIEF SUMMARY OF THE INVENTION

The primary object of the invention is to provide a convenient and attractive means of record keeping with respect to in-use personal apparel.

Another object of the invention is to provide an advertising medium with such useful qualities such that the consumer has an incentive to retain it.

Another object of the invention is to provide an inexpensive-to-produce record keeping device for garments.

A further object of the invention is to maximize available space and utility for clothing data records.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for recording or assigning the use of articles of apparel comprising: a sheet of stiff material substantially symmetrical about a horizontal axis, upon said axis which it is folded and perforated so as would facilitate mounting the device over the hook of a hanger, one or more substantially flat surfaces upon which notes, assignments, usage advertisements, or other data maybe recorded, at least two ends, and at least two Inside faces.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
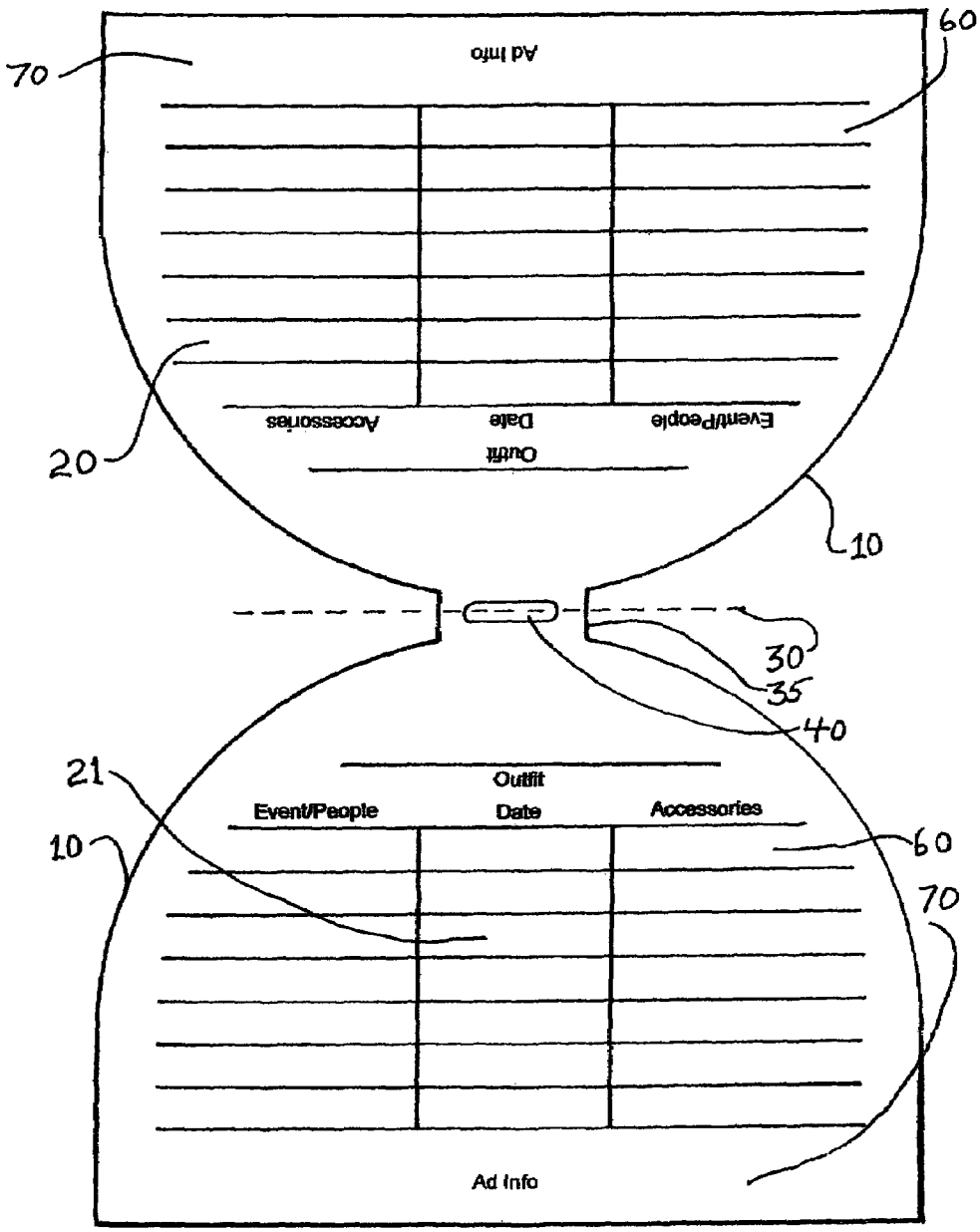
FIG. 1 is a plan view of the invention showing the exterior surfaces.
Figure 2:
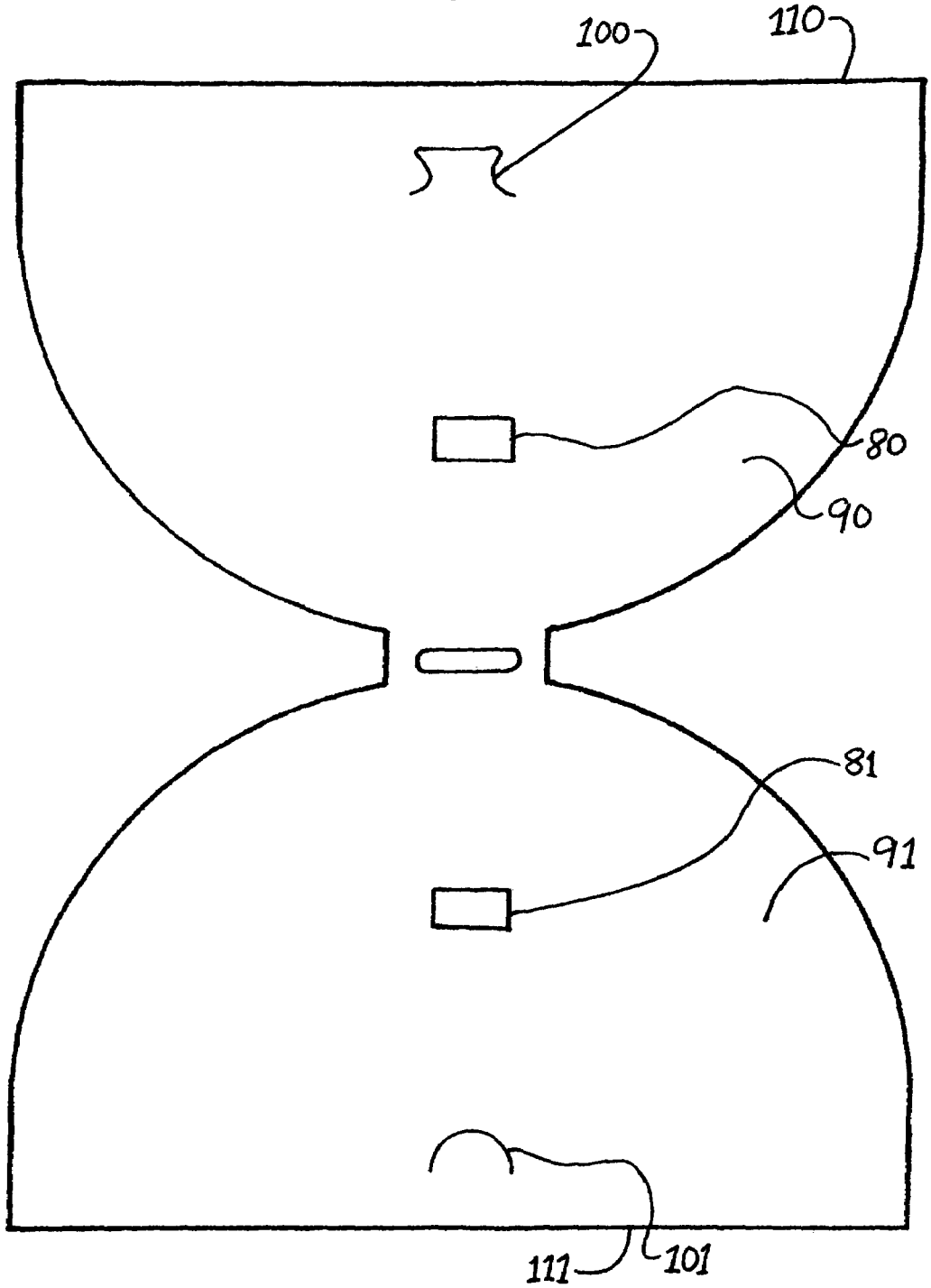
FIG. 2 is a plan view of the invention showing the interior surfaces.

FIG. 1 is a plan view of the invention exterior surfaces, of the machine for recording or assigning use of articles of apparel. The body (10) of the device is substantially comprised of stiff material such as card stock or plastic sheets, and has one or more writing surfaces thereon (20) and (21). It is formed, symmetrically or asymmetrically, about an axis (30) upon which it may be folded. This axis material (35) may be comprised of the same material as the body, or it may be comprised of a hinge or of pliable or foldable material such as ribbon or cloth and is configured with a space or opening (40) that can accept a clothes hanger hook (50). (See FIG. 3.)

With the device folded at the axis (30) and the opening (40) slipped over the hook (50) of a clothes hanger, it presents two exterior surfaces (20) and (21) upon which data (60) and/or advertising copy (70) may be recorded and displayed.

Referring to FIG. (2), in order to better secure the device in place, once it is on a clothes hanger, fasteners or connectors (80) and (81) such as Velcro™ hooks, or adhesive surfaces may be mounted on the inner faces (90) and (91) of the device. Alternatively, or, additionally, a tab (100) and slot (101) may be incorporated in the vicinity of opposing ends (110) and (111) to better secure the device in place.

Figure 3:
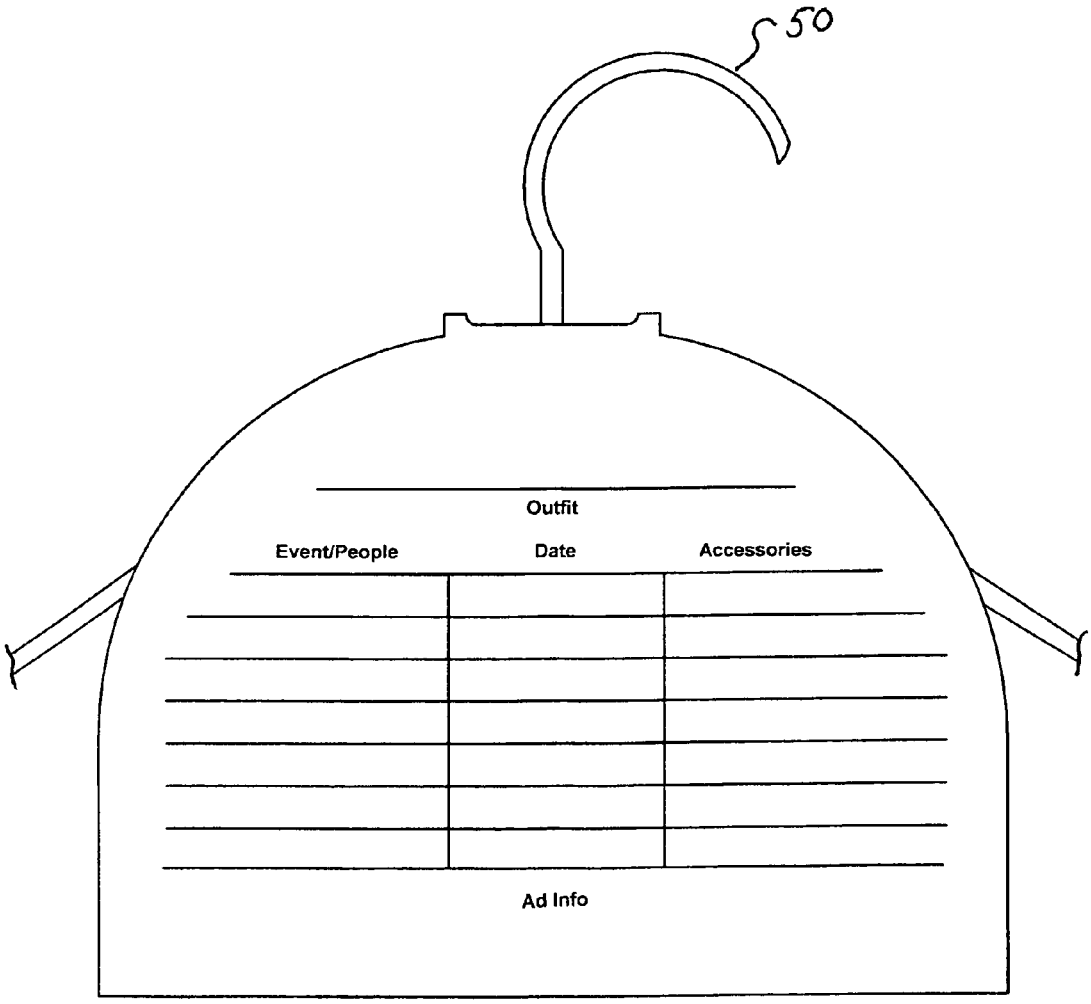
FIG. 3 illustrates the device mounted for use.

Referring to FIG. 3, is illustrated the device configured on a clothes-hanger for use.

Figure 4:
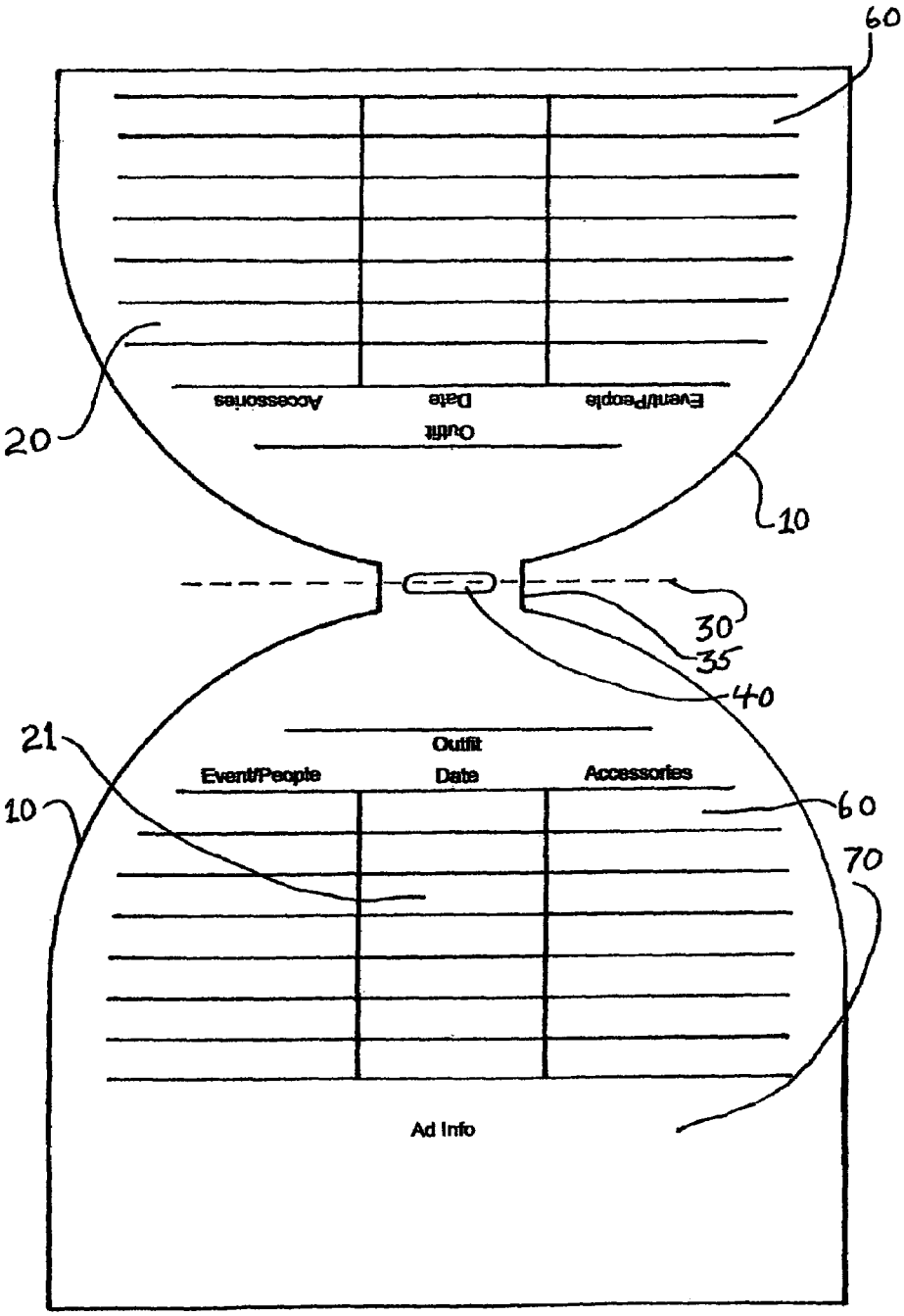
FIG. 4 illustrates the device in one assymetrical form

Referring to FIG. 4, it is demonstrated that asymmetric form is a viable configuration.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A device for recording or assigning the use of articles of apparel consisting of:

a sheet of stiff material formed about a horizontal axis, upon said axis which it is folded using only a single fold, said single fold having a center, said center provided with an opening, said opening configured to facilitate mounting the device over a hook of a clothes hanger, two ends, and two opposing inside faces, said inside faces being created when the device is folded, and wherein, fasteners are mounted in such a way as to more securely hold the device in place, said device having, when folded, a vertical height of no more than 8 inches and a width of no more than 10 inches, said width, thereby, not extending to or beyond either end of said hanger and also consisting of two substantially flat exterior surfaces on which may be textually recorded by pen, pencil or crayon, the date the garment was acquired, date the garment was worn, location where the garment was worn, event to which the garment was worn, accessories worn with the garment, or other data regarding the disposition of a garment.

2. A device for recording or assigning the use of articles of apparel consisting of:

a sheet of stiff material formed about a horizontal axis, upon said axis which it is folded using only a single fold, said single fold having a center, said center provided with an opening, said opening configured in such a way as to facilitate mounting the device over a hook of a clothes hanger, two ends, and opposing inside faces, said inside faces being created when the device is folded, and whereupon, fasteners are mounted in such a way as to secure the device in place, said device having, when folded, a vertical height of no more than 8 inches and a width of no more than 10 inches, said width, thereby, not extending to or beyond either end of said hanger and also consisting of two substantially flat exterior surfaces substantially centered between the said two ends, and possessed of a surface compatible with application of textual records thereon, via pen, pencil or crayon.

* * * * *